US006106318A

United States Patent [19]

Chiu

[11] Patent Number: 6,106,318

[45] Date of Patent: Aug. 22, 2000

[54] MEMORY MODULE SOCKET WITH LATCH

[75] Inventor: Allen Chiu, Santa Clara, Calif.

[73] Assignee: Hon Hai Precision Ind. Co., Ltd., Taipei Hsien, Taiwan

[21] Appl. No.: 09/354,965

[22] Filed: Jul. 6, 1999

[30] Foreign Application Priority Data

Jul. 16, 1998 [TW] Taiwan ..... 87211446

[51] Int. Cl.[7] ..... H01R 13/62

[52] U.S. Cl. ..... 439/326

[58] Field of Search ..... 439/326, 328, 439/327, 325

[56] References Cited

U.S. PATENT DOCUMENTS 5,244,403 9/1993 Smith et al. ..... 439/326

5,413,496 5/1995 Yu ..... 439/326

5,888,086 3/1999 Yaegashi ..... 439/326

*Primary Examiner*—Gary F. Paumen

*Attorney, Agent, or Firm*—Wei Te Chung

[57] ABSTRACT

A memory module socket with resilient latches for retaining a memory module therein comprises: a housing, a number of contacts, and a pair of latches. Each latch is formed at one side of the housing, and has a lock portion and an engaging portion. The lock portion extends from one end of the housing and comprises an engaging member and a resilient plate which is insert molded therein. The engaging portion comprises a front plate and a back plate. The front plate forms a slot to engage the lock portion.

10 Claims, 7 Drawing Sheets

MEMORY MODULE SOCKET WITH LATCH

BACKGROUND OF THE INVENTION

The present invention relates to an electrical connector, and more particularly to a memory module socket with a latch for locking a memory module received by the socket.

Computers comprise arrays of interconnected circuit boards. A memory module socket is mounted on a mother board for engaging a memory module thereby connecting the memory module with the mother board. The memory modules are first inserted into the memory module sockets at a first angle with low insertion forces but do not get engaged with contacts of the sockets. To achieve engagement, the memory modules are subsequently pivoted from the first angle to a second angle and then engage with the contacts of the sockets for achieving an electrical connection. However, the movement of an edge of the memory modules within the sockets causes contacts to resiliently deflect, whereby the memory module sockets require latches to lock the memory modules at the connecting position to prevent the memory modules from detachment. The prior art includes plastic latches and metal latches, but the plastic latches have a poor resilience and the metal latches are costly.

The combination of plastic and metal latches are shown in Taiwan Patent Application No. 84100813 and U.S. Pat. Nos. 5,004,429; 5,470,240; 5,074,800; 5,676561; 5,584,705; 5,676,555 and 5,695,354. Although the latches of the above patents provide good resilience and strength, the structures are complex. Furthermore, when an operator intends to release the lock between the latches and the memory module, damage to the latches due to overstress may result, since there is no structure in the prior art sockets which can prevent the latches from an undue deformation. In view of the above, an object of the subject invention is to provide a block to limit movement of the latch.

A further object of the subject invention is to provide a latch having good resilience and which is not easily broken.

BRIEF SUMMARY OF THE INVENTION

A main object of the present invention is to provide a memory module socket with latches having a resilient plate insert molded in the lock portion for increasing the strength and resiliency of the latches.

Another object of the present invention is to provide a latch having an engaging portion and a slot extending from a front plate to engage a lock portion for preventing the lock portion from becoming damaged or permanently deformed.

A main feature of the present invention is that a memory module socket has latches each comprising a lock portion extending from one side of a housing, the lock portion having an engaging member and a resilient plate insert molded therein. The resilient plate is bent to be L-shaped for increasing the resiliency of the lock portion. The resilient plate defines notches in edges thereof for increasing an engaging area.

The second feature of the present invention is that the lock portion comprises a resilient piece and a support portion having a slot.

The third feature of the present invention is to provide an engaging portion in each latch. The engaging portion comprises a front plate, a back plate, a slanting plate connected therebetween, and a slot extending from one edge of the front plate to engage the resilient piece of the lock portion.

Other objects, advantages and novel features of the invention will become more apparent from the following detailed description when taken in conjunction with the accompanying drawings.

DETAILED DESCRIPTION OF THE INVENTION

Figure 1:
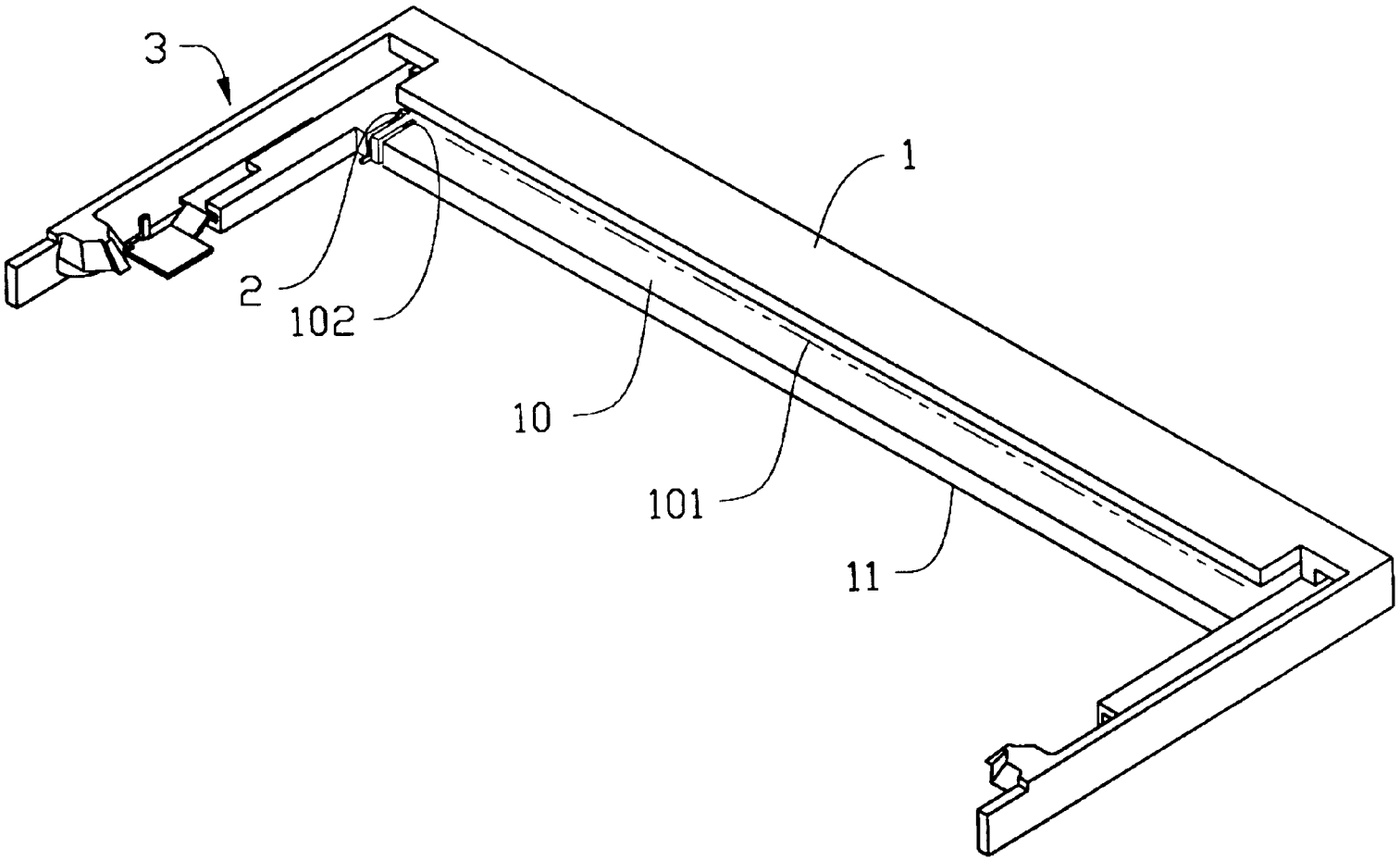
FIG. 1 is a perspective view of a memory module socket with a pair of latches of the present invention.

Referring to FIG. 1, a memory module socket in accordance with the subject invention comprises a housing 1, a plurality of contacts 2, and a pair of latches 3. The housing 1 has a rectangular configuration with a mating face 10 and a soldering face 11. An insertion slot 101 is defined in the mating faces 10. A plurality of contact passageways 102 is defined for receiving the contacts 2. The soldering face 11 is soldered to a mother board (not shown).

Figure 2:
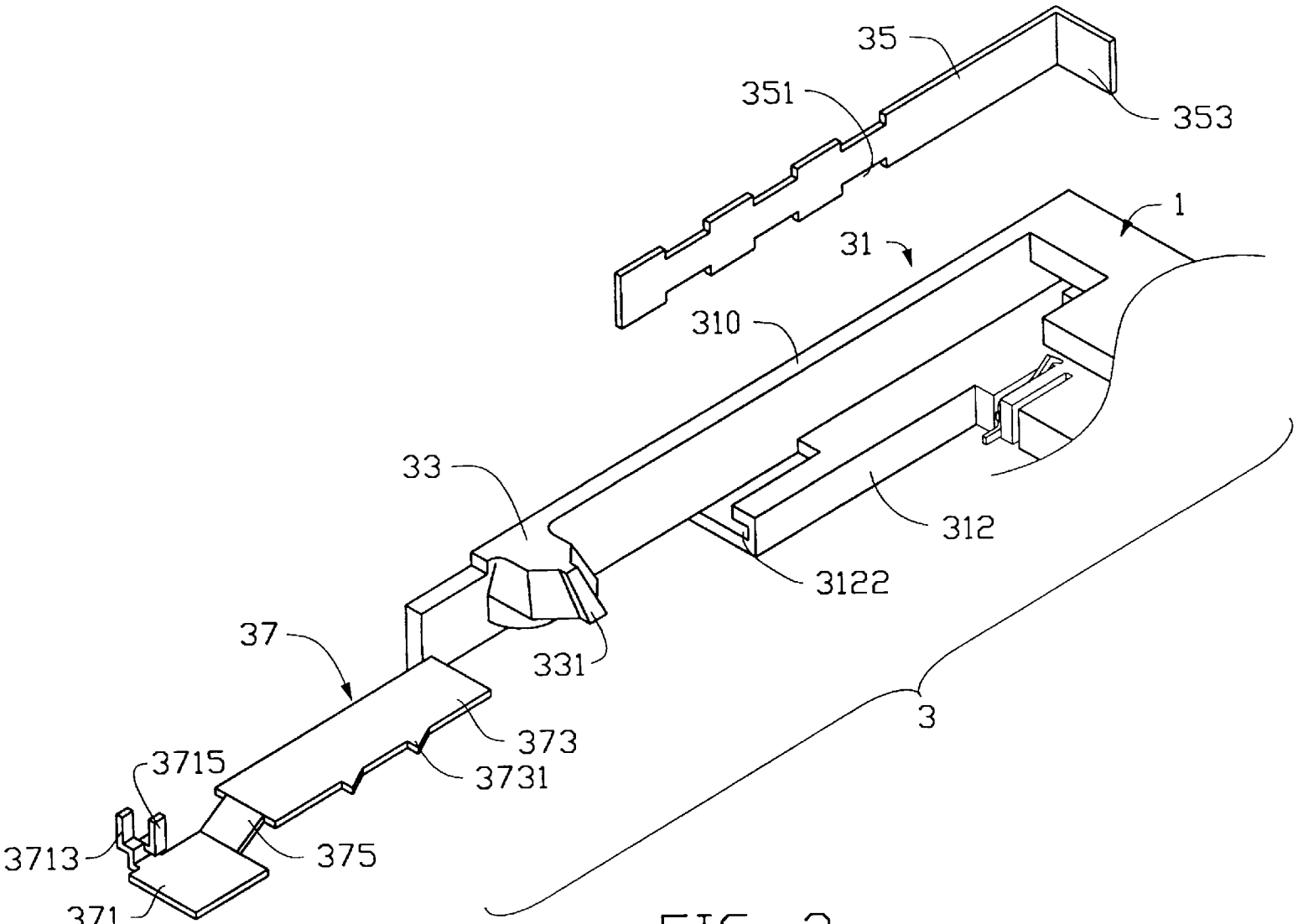
FIG. 2 is an exploded view of a portion of the memory module socket and the latch.
Figure 3:
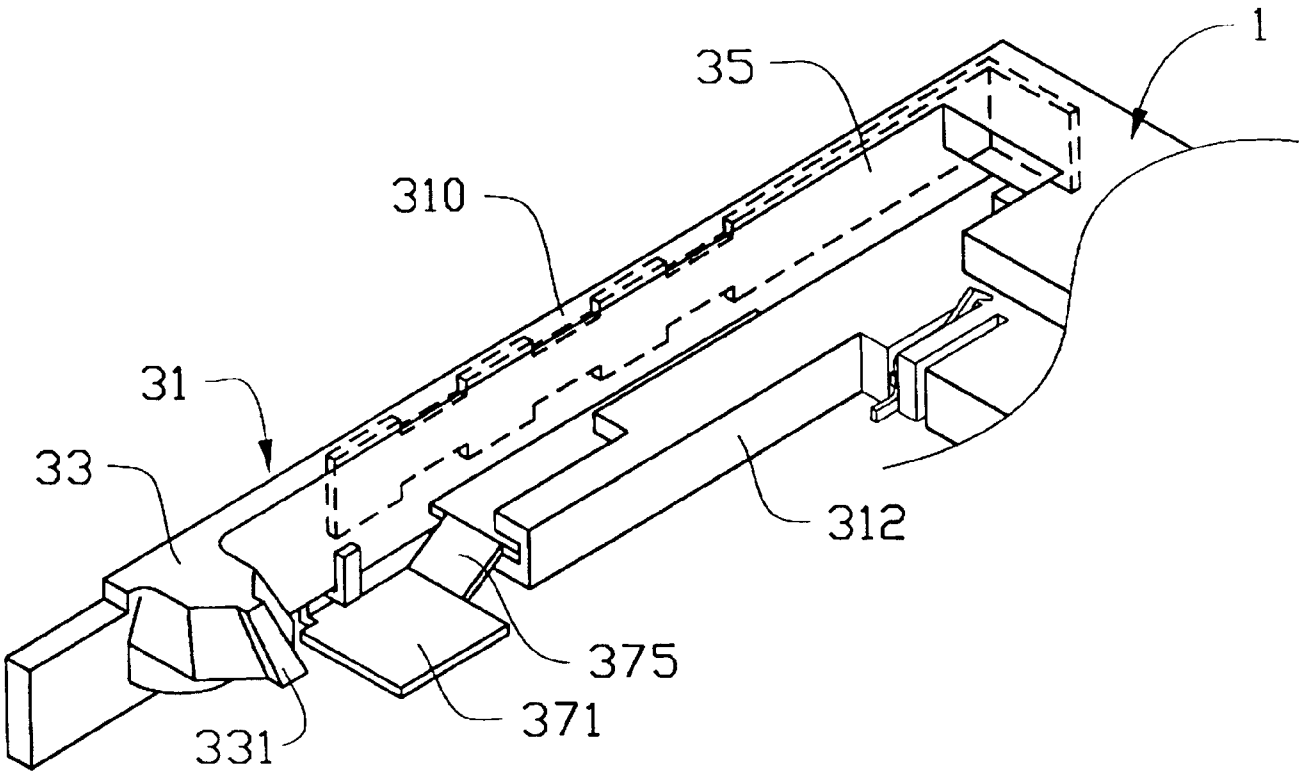
FIG. 3 is an assembled view of FIG. 2 with a resilient plate of the latch shown in dashed lines.
Figure 5A:
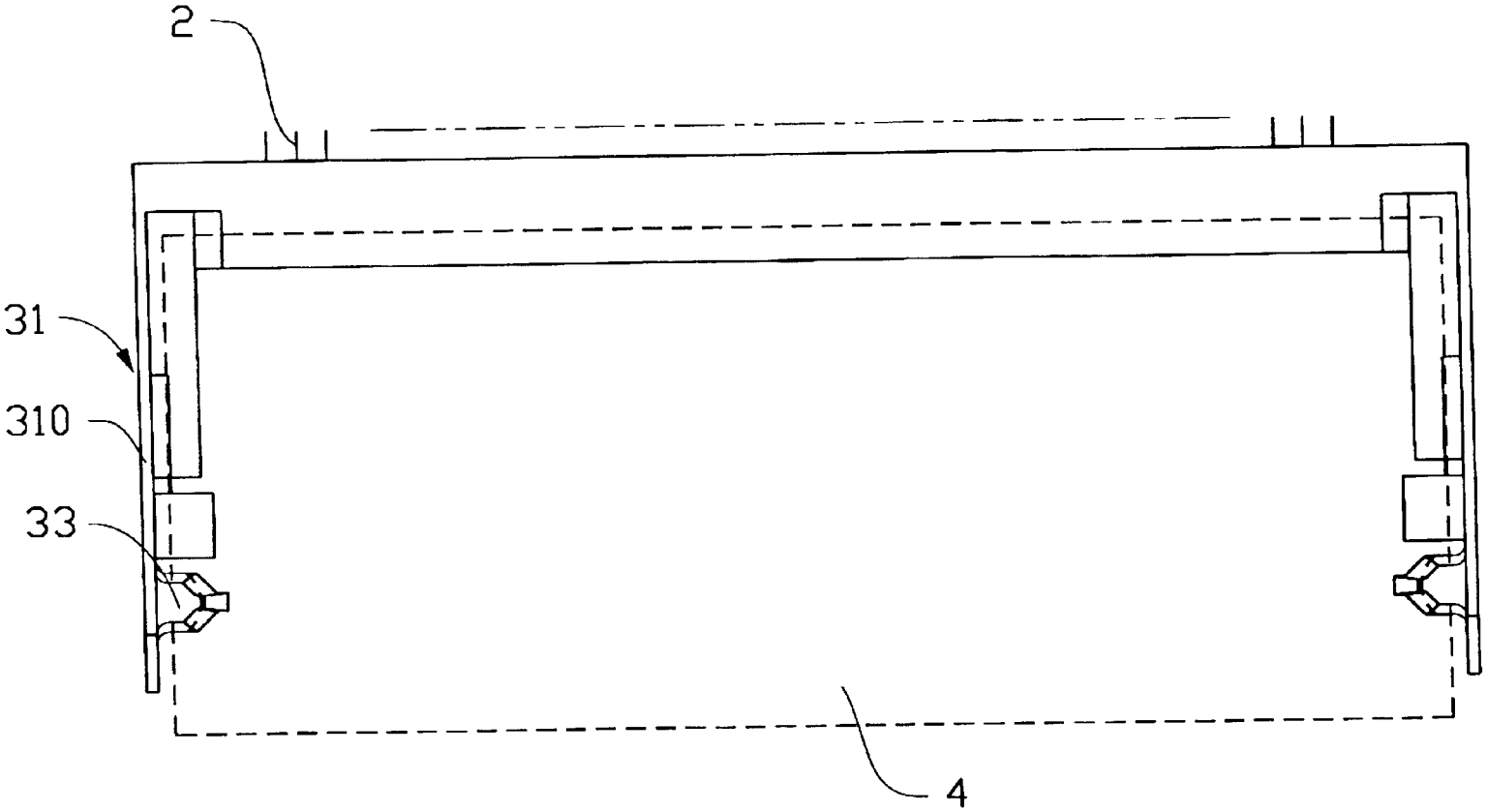
FIGS. 5A and 5B are schematic views of the memory module socket with the latch engaging with and disengaging from a memory module.
Figure 5B:
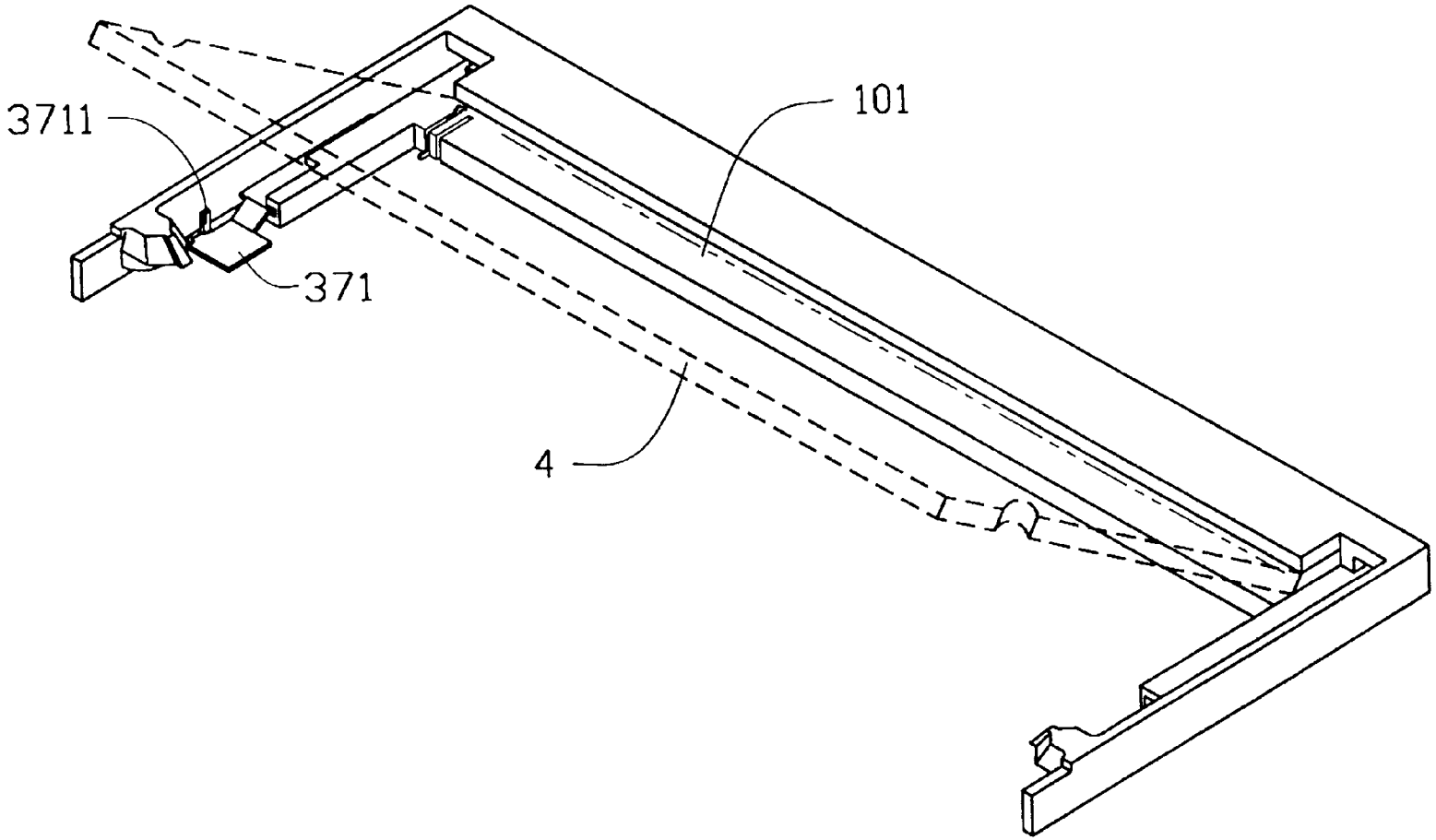

The latches. 3 extend from opposite sides of the housing 1. The latches 3 engage and disengage a memory module 4 (FIGS. 5A and 5B). With reference to FIGS. 2 and 3, each latch 3 comprises a lock portion 31 extending from the housing 1. The lock portion 31 comprises an engaging member 33 and a resilient plate 35 made by stamping a metal sheet. The resilient plate 35 comprises an L-shaped bent portion 353 insert molded in the housing 1 thereby enhancing the resiliency of the lock portion 31. A plurality of notches 351 is defined in the edges of the resilient plate 35 to increase an engaging area of the resilient plate 35. The engaging member 33 forms a protrusion 331. The lock portion 31 comprises a rectangular resilient piece 310 and a support portion 312. The support portion 312 defines a slot 3122 for receiving an engaging portion 37 made by stamping a metal plate. The engaging portion 37 comprises a front plate 371 and a back plate 373. A slanting plate 375 connects the two plates 371, 373. The front plate 371 is located lower than the back plate 373. The back plate 373 forms a plurality of barbs 3731 for engaging with the support portion 312. The front plate 371 is a square metal plate to be soldered on a mother board (not shown) for increasing the joint force between the socket and the mother board.

Figure 4:
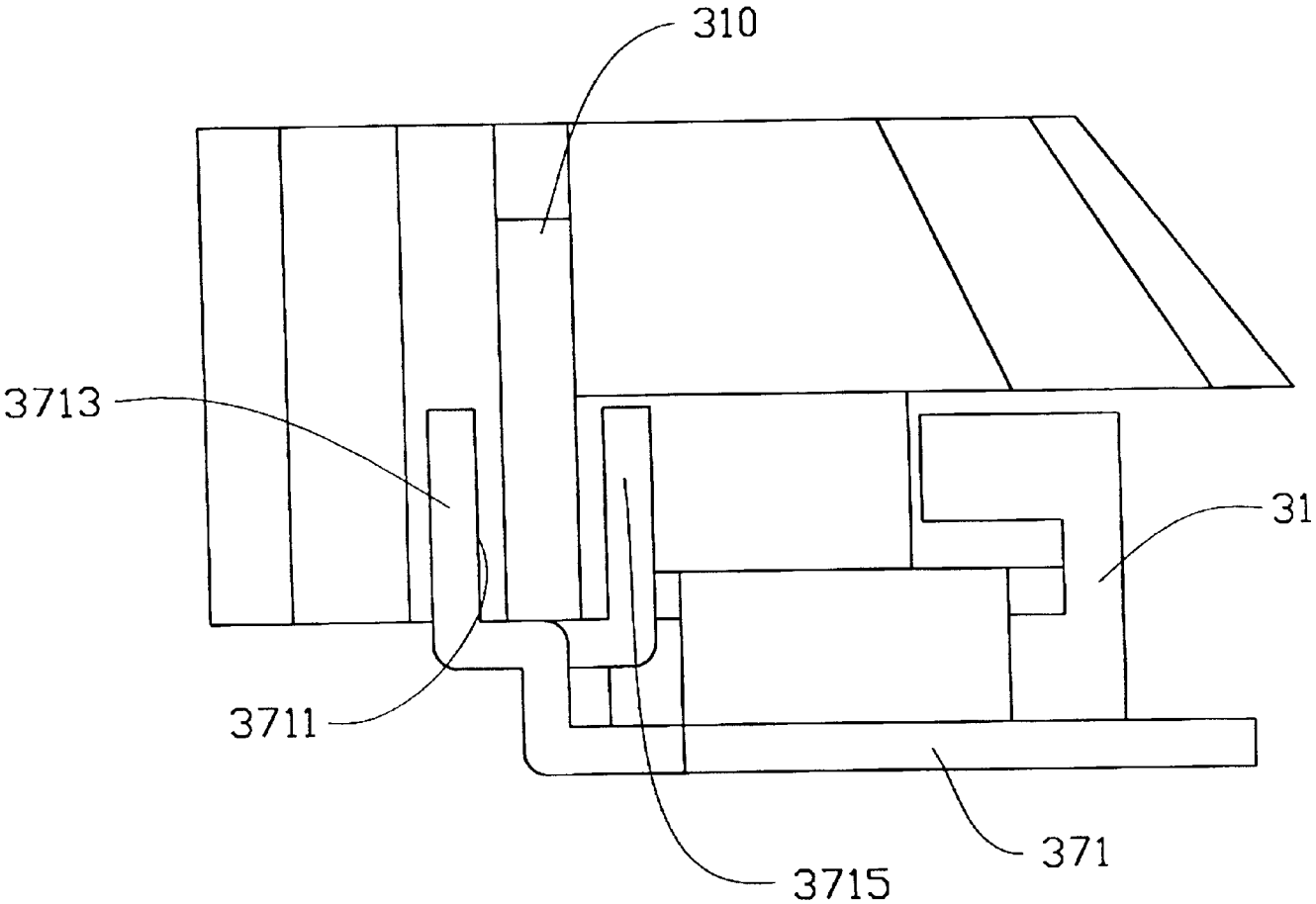
FIG. 4 is a front elevational view of an engaging structure of the latch.

Also referring to FIG. 4, a first block 3713 and a second block 3715 extend from the front plate 371 to form a slot 3711 for receiving the resilient piece 310 of the lock portion 31 thereby regulating a movement thereof. Due to the provision of the first and second blocks 3713, 3715, undue deformation and damage of the lock portion 31 during engagement and disengagement of a memory module 4 (FIGS. 5A and 5B) are prevented.

With reference to FIGS. 5A and 5B, the memory module 4 is inserted into the engaging slot 101 at an angle (FIG. 5B). The memory module 4 is then pressed to a designated position and engaged by the engaging member 33 of the lock portion 31 whereby the contacts 2 electrically engage with the memory module 4 (FIG. 5A). If the memory module 4 requires disengagement, the resilient portions 310 are outwardly displaced and the engaging member 33 can be detached from the memory module 4. The memory module 4 is pivoted to the position of insertion and then removed. During engagement/disengagement of the memory module 4, the slot 3711 of the front plate 371 limits a movement of the lock portion 31 to prevent the lock portion 31 from being damaged or permanently deformed.

Figure 6:
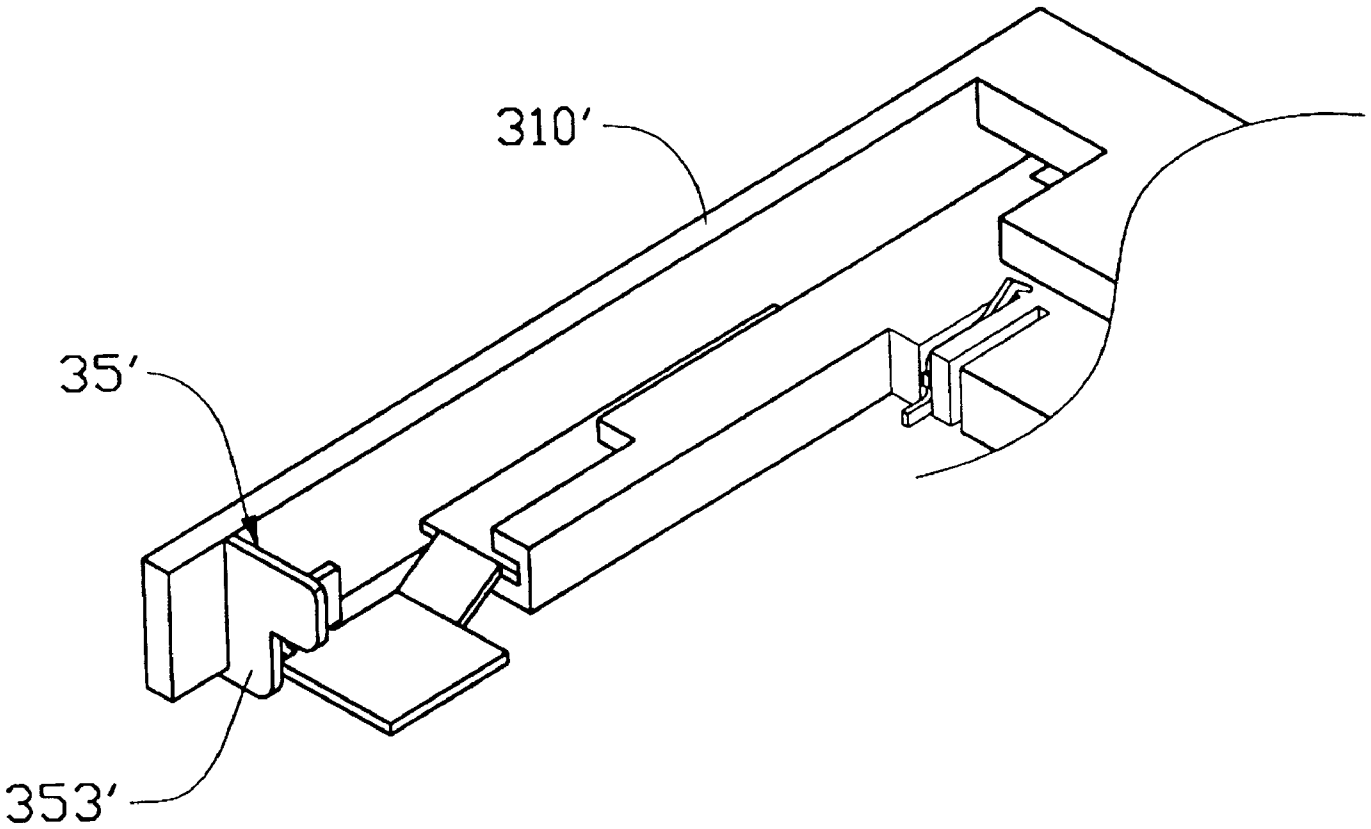
FIG. 6 is a perspective view of a latch mounted to a memory module socket in accordance with a second embodiment of the present invention.

FIG. 6 illustrates a second embodiment of the present invention. A resilient plate 35' is similar to the resilient plate 35 of the first embodiment except for a bent portion 353' which is L-shaped. The resilient plate 35' is insert molded in a resilient portion 310'. The bent portion 353' protrudes from the resilient portion 310' to serve the same function as the engaging member 33 of the first embodiment to engage a memory module (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fall extent indicated by the broad general meaning of the terms in which the appended claims are expressed.

What is claimed is:

1. A memory module socket mounted to a circuit board comprising:

a housing having a mating face and a soldering face, an insertion slot being defined inside the mating face for receiving an edge of a memory module, and a plurality of contact passageways in communication with the slot;

a plurality of contacts received in the contact passageways;

a latch defined at one side of the housing and having a lock portion extending from one side of the housing, the lock portion comprising a resilient piece, an engaging member, a separate resilient plate and a first slot, the engaging member engaging an edge of the memory module, the resilient plate being attached to the lock portion; and a separate engaging portion comprising a front plate, a back plate, a slanting piece connecting the front and back plates, the back plate securely engaged in the first slot, and a first block and a second block extending from the front plate on opposite sides of the resilient plate to form a second slot to regulate a movement of the resilient plate of the lock portion.

2. The memory module socket as claimed in claim 1, wherein the resilient plate has an L-shaped bent section to be insert molded in the housing.

3. The memory module socket as claimed in claim 1, wherein the engaging member has a protrusion.

4. The memory module socket as claimed in claim 1, wherein the resilient plate defines notches in edges thereof to increase an engaging area with the lock portion.

5. The memory module socket as claimed in claim 1, wherein the lock portion has an elongate resilient piece and a support portion, the elongate resilient piece having a first part engaged with the support portion and a second part carrying the engaging member.

6. The memory module socket as claimed in claim 5, wherein the first slot is defined in an edge of the support portion.

7. The memory module socket as claimed in claim 1, wherein the front plate and the back plate lie in different levels.

8. The memory module socket as claimed in claim 1, wherein the back plate forms a plurality of barbs.

9. The memory module socket as claimed in 1, wherein the front plate is a square metal plate.

10. The memory module socket as claimed in claim 9, wherein the L-shaped shaped bent section of the resilient plate protrudes from the lock portion to displace the engaging member to engage the memory module.

* * * * *